US012486859B2

(12) United States Patent
Li

(10) Patent No.: US 12,486,859 B2
(45) Date of Patent: Dec. 2, 2025

(54) AIR PUMP COVER AND AIR PUMP

(71) Applicant: Shanghai Flextail Technology Co., Ltd., Shanghai (CN)

(72) Inventor: Tao Li, Shanghai (CN)

(73) Assignee: Shanghai Flextail Technology Co., Ltd, Shanghai (CN)

( * ) Notice: Subject to any disclaimer, the term of this patent is extended or adjusted under 35 U.S.C. 154(b) by 0 days.

(21) Appl. No.: 18/562,381

(22) PCT Filed: Jul. 19, 2022

(86) PCT No.: PCT/CN2022/106423
§ 371 (c)(1),
(2) Date: Nov. 20, 2023

(87) PCT Pub. No.: WO2023/206829
PCT Pub. Date: Nov. 2, 2023

(65) Prior Publication Data

US 2024/0247664 A1 Jul. 25, 2024

(30) Foreign Application Priority Data

Apr. 27, 2022 (CN) ..... 202221089198.1

(51) Int. Cl.
*F04D 29/60* (2006.01)
*F04D 25/02* (2006.01)
*F04D 29/40* (2006.01)

(52) U.S. Cl.
CPC ..... *F04D 29/601* (2013.01); *F04D 29/403* (2013.01); *F04D 25/02* (2013.01)

(58) Field of Classification Search
CPC ..... F04D 29/601; F04D 29/403; F04D 25/02; F04D 25/084; F04D 29/00; F04D 29/02;
(Continued)

(56) References Cited

U.S. PATENT DOCUMENTS 2,160,278 A * 5/1939 Ness ..... A47L 7/0071 417/363
6,237,653 B1 * 5/2001 Chaffee ..... F04D 25/0673 141/114

(Continued)

FOREIGN PATENT DOCUMENTS

CN 107939744 A 4/2018
CN 209324692 U 8/2019

(Continued)

OTHER PUBLICATIONS

Author: Zhou, Jianjia (Authorized official), International Search Authority China (ISA/CN) Title: International search report (for PCT/CN2022/106423) Date: Nov. 22, 2022.

(Continued)

*Primary Examiner* — Mark A Laurenzi
*Assistant Examiner* — Benjamin Doyle
(74) *Attorney, Agent, or Firm* — Woodard, Emhardt, Henry, Reeves & Wagner, LLP

(57) ABSTRACT

The application discloses an air pump upper cover and an air pump. The air pump upper cover comprises a main body and a magnetic element arranged in the main body. The main body comprises a first cover body and a second cover body. The second cover body extends towards the first cover body to form an annular boss. An avoidance hole is formed in the first cover body at the area corresponding to the annular boss and a gap is formed between the avoidance hole and the annular boss. The magnetic element is arranged around the avoidance hole, and the first cover body and the second cover body jointly form a chamber used for containing the magnetic element. By arranging the magnetic element, the air pump can be attached to metal parts via magnetic force so as to adapt to various application scenes, and the universality and practicability of the air pump are improved. Meanwhile, the magnetic element is arranged around the (Continued)

avoiding hole, so the air pump can be stably attached to metal parts, without impacting the inflation function. The structural arrangement is optimized, and the space utilization rate is high. In addition, a gap is formed between the avoidance hole and the annular boss, so that the air pump can be connected to various external products more easily, and the universality of the air pump is further improved.

20 Claims, 8 Drawing Sheets

(58) Field of Classification Search
CPC ..... F04D 29/40; F04D 29/4226; F04D 29/66; F04D 29/42; F04D 29/002; F04D 29/624; F04D 29/661; F05D 2210/12
USPC ..... 417/423.1
See application file for complete search history.

(56) References Cited

U.S. PATENT DOCUMENTS

| | | | | |
|---|---|---|---|---|
| 9,426,903 | B1 * | 8/2016 | Morales | H05K 7/20145 |
| 2012/0107157 | A1 * | 5/2012 | Tsai | F04D 17/162 417/423.14 |
| 2018/0001248 | A1 * | 1/2018 | Jung | B01D 46/2411 |
| 2020/0046135 | A1 * | 2/2020 | Lau | F04D 25/0606 |
| 2020/0191420 | A1 * | 6/2020 | Lee | F24F 1/0047 |
| 2021/0404704 | A1 * | 12/2021 | Phillips | F24F 1/035 |
| 2022/0082277 | A1 * | 3/2022 | Lowe | F24F 13/068 |
| 2022/0094379 | A1 * | 3/2022 | Balderston | H04B 1/3877 |

FOREIGN PATENT DOCUMENTS

| | | | | | |
|---|---|---|---|---|---|
| CN | 211550049 | U | | 9/2020 | |
| CN | 211692889 | U | | 10/2020 | |
| CN | 214944849 | U | | 11/2021 | |
| CN | 215486719 | U | | 1/2022 | |
| CN | 215830740 | U | | 2/2022 | |
| CN | 215860917 | U | | 2/2022 | |
| CN | 217271013 | U | | 8/2022 | |
| CN | 217462617 | | * | 9/2022 | F04D 25/08 |
| CN | 217462617 | U | | 9/2022 | |
| DE | 202010008957 | U1 | | 6/2011 | |
| JP | 2000227095 | A | | 8/2000 | |
| KR | 20140144795 | A | | 12/2014 | |

OTHER PUBLICATIONS

Author: Zhou, Jianjia (Authorized official), International Search Authority China (ISA/CN) Title: Written opinion of the ISA (for PCT/CN2022/106423) Date: Nov. 24, 2022.

Author: Zeng, Xinzhuo (Examiner), China National Intellectual Property Administration (CNIPA) Title: Evaluation report of utility model patent (for patent No. 202221089198.1) Date: Nov. 4, 2022.

* cited by examiner

AIR PUMP COVER AND AIR PUMP

FIELD OF THE DISCLOSURE

Aspects of the present application deal with air pumps. More particularly, the present application deals with an air pump upper cover and an air pump.

BACKGROUND

An air pump is a tool that inflates equipment through the operation of a motor. At present, with the continuous improvement of the quality of the people's of life, the types of entertainment projects are gradually increasing, and the frequency of the use of air pumps is also increasing. An air pump can not only inflate equipment such as various vehicle tires, kayaks, air cushions, etc., but can also inflate various balls, life-saving equipment, toys and other equipment, and has a wide range of applications.

However, in the prior arts, the application scenarios of the commonly used air pumps are relatively limited, and the air pumps cannot be well fixed to a preset position, and the structural configuration of the air pumps are not very optimized, and the space utilization rate is low.

Therefore, how to solve these technical issues existing in the prior arts has always been an urgent problem to be solved by those skilled in the art.

SUMMARY OF THE INVENTION

The purpose of the application is to provide an air pump upper cover and an air pump, to enrich the application scenarios of air pumps, and to improve the versatility of air pumps. At the same time, the structural configuration is optimized and the space utilization rate is high.

The technical solution provided by the application is as follows:

An air pump upper cover, comprising:

a main body and a magnetic element arranged in the main body;

wherein the main body includes a first cover body and a second cover body, and the second cover body is provided with an annular boss extending towards the first cover body, and the first cover body is provided with an avoidance hole corresponding to the annular boss, and a gap is provided between the avoidance hole and the annular boss;

wherein the magnetic element is disposed around the avoidance hole, while the first cover body and the second cover body together form a chamber for accommodating the magnetic element.

In some embodiments, an edge of the avoidance hole includes a contacting boss extending towards the second cover body for docking the second cover body, and, a side of the first cover body facing the second cover body is provided with a plurality of contacting blocks, which contact and hold the magnetic element together with the contacting boss;

or, at a side facing the first cover body and at the area corresponding to the avoidance hole, the second cover body includes a contacting boss extending towards the first cover body, for docking the first cover body, and, a side of the first cover body facing the second cover body is provided with a plurality of contacting blocks, which contact and hold the magnetic element together with the contacting boss.

In some embodiments, the magnetic element has a ring-shaped structure and surrounds the contacting boss;

and the contacting blocks are evenly spaced around the avoidance hole.

In some embodiments, an inner side of the annular boss is provided with a stopper for preventing a user's fingers from being involved;

and/or, a side of the annular boss facing the first cover body is provided with a plurality of cavities, and a reinforcing rib is formed between every two adjacent cavities;

and/or, the second cover body is provided with a plurality of cavities at an area corresponding to the magnetic element, and a reinforcing rib is formed between every two adjacent cavities.

In some embodiments, a hanging ring is provided on a side of the first cover body away from the second cover body.

In some embodiments, an edge of the first cover body is provided with a placement groove for placing the hanging ring, and a side wall of the placement groove is provided with at least one locking block for holding the hanging ring.

This application also provides an air pump, comprising:

a casing, an impeller, a driving member and an air pump upper cover according to any embodiment described above;

wherein a side edge or a bottom of the casing is provided with an exhaust port, and the interior of the casing is provided with a first chamber and a second chamber, which are respectively used for placing the impeller and the driving member, wherein the impeller and the driving member are operably connected;

wherein the air pump upper cover covers the first chamber, and when driven by the driving member, the impeller sucks external gas into the first chamber through the annular boss, and vents the gas through the exhaust port.

In some embodiments, a side of the first cover body facing the casing is provided with an engaging groove for docking with the casing.

In some embodiments, an edge of the first chamber is provided with a positioning block, and a corresponding area of the second cover body is provided with a positioning hole;

wherein the positioning block is snap-fitted with the positioning hole to position the casing and the air pump upper cover.

In some embodiments, a side of the impeller facing the air pump upper cover, at an end facing a side wall of the first chamber, is provided with a first drainage slope, so as to guide the gas in the first chamber to the circumference of the first chamber; and, at a side facing the casing, and at a region corresponding to the first drainage slope, the second cover body is provided with a second drainage slope parallel to the first drainage slope.

The technical effects of the present application are:

1. In this application, by providing a magnetic element, the air pump can be attached to metal parts via magnetic attraction force, so as to adapt to various application scenarios and improve the versatility and practicability of the air pump. At the same time, the magnetic element is arranged around the avoidance hole, which enables stable attachment of the air pump to the metal parts without affecting the inflation function of the air pump. The structure is optimized and the space utilization rate is high. In addition, the configuration of a gap between the avoidance hole and the annular boss is conducive to the connection of the air pump to various products, which further improves the versatility of the air pump.

2. In this application, by providing the hanging ring, the air pump can be hung at the required position, which increases the application scenarios of the air pump and greatly improves its versatility. At the same time, the application provides a placement groove for placing the hanging ring, which optimizes the overall structure and makes the shape of the air pump more aesthetic.

3. In this application, by providing the first drainage slope and the second drainage slope, the gas in the first chamber is guided to the edge of the first chamber, and the utilization rate of the gas in the first chamber and the inflation efficiency are improved. At the same time, setting the first drainage slope and the second drainage slope can also effectively reduce the collision between the gas and the first chamber. While avoiding the impact of the collision on the gas flow rate, the configuration also reduces the noise generated by the high-speed gas and reduces the noise pollution of the air pump to the environment.

BRIEF DESCRIPTION OF THE DRAWINGS

In conjunction with the accompanying drawings and specific embodiments, the application is described in further details below.

DESCRIPTION OF THE REFERENCE NUMBERS

Figure 1:
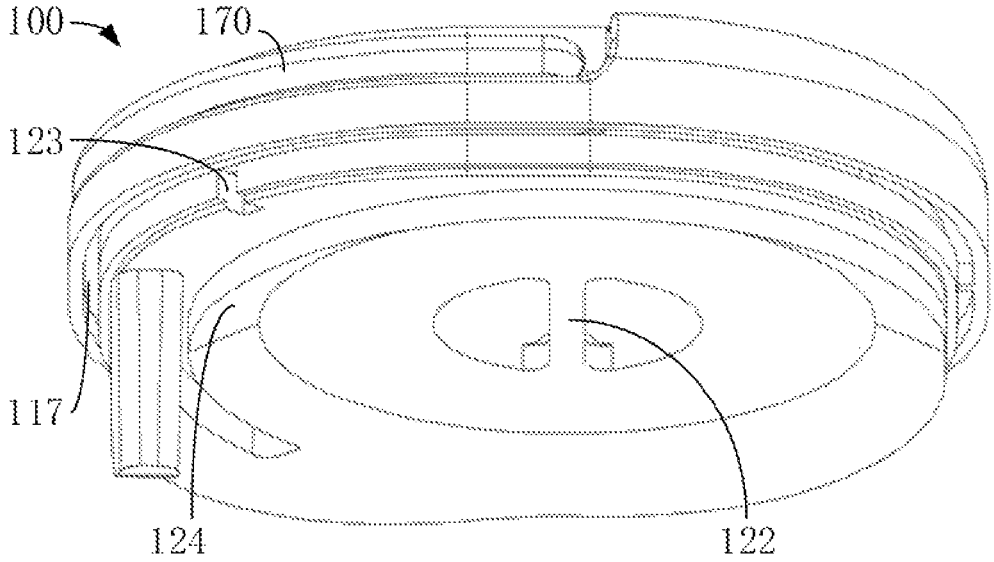
FIG. 1 is a three-dimensional schematic structure diagram of the air pump upper cover provided by this application.

100, air pump upper cover; 110, first cover body; 111, avoidance hole; 112, contacting boss; 113, contacting block; 114, mounting hole; 115, placement groove; 116, locking block; 117, engaging groove; 120, second cover body; 121, annular boss; 122, stopper; 123, positioning hole; 124, second drainage slope; 130, magnetic element; 140, chamber; 150, cavity; 160, reinforcing rib; 170, hanging ring; 200, casing; 210, first chamber; 211, positioning block; 220, second chamber; 300, impeller; 310, first drainage slope; 400, driving member.

DESCRIPTION OF THE ILLUSTRATED EMBODIMENTS

In order to more clearly illustrate the embodiments of the present application or the technical solutions in the prior art, the specific embodiments of the present application will be described below with reference to the accompanying drawings. Obviously, the accompanying drawings in the following description are only some embodiments of the present application, and for those of ordinary skill in the art, other drawings can also be obtained from these drawings without creative efforts, to obtain other embodiments.

In order to keep the drawings concise, only the parts related to the application are schematically shown in each figure, and they do not represent the actual structure of the products. In addition, in order to make the drawings concise and easy to understand, in some figures, only one of the components having the same structure or function is schematically shown, or only one of them is marked. As used herein, "one" not only means "only one", but also "more than one".

It should also be further understood that, as used in this specification and the claims, the term "and/or" refers to and including any and all possible combinations of one or more of the associated listed items.

In this description, it should be noted that, unless otherwise expressly specified and limited, the terms "installed", "connected" and "connecting" should be understood in a broad sense. For example, it may be a fixed connection or a detachable connection, or it can be connected into a whole piece; or it can be a mechanical connection or an electrical connection; or it can be directly connected or indirectly connected through an intermediate medium, and it can be internal communication between two components. For those of ordinary skill in the art, the specific meanings of the above terms in the present application can be understood in specific situations.

In addition, in the description of the present application, the terms "first", "second" and the like are only used to distinguish the features, and should not be understood as indicating or implying relative importance.

According to a specific embodiment provided by the present application, referring to FIG. 1 to FIG. 10, an air pump upper cover and an air pump are provided. The air pump upper cover 100 may specifically include a main body and a magnetic element 130 disposed in the main body. The main body includes a first cover body 110 and a second cover body 120. The second cover body 120 is provided with an annular boss 121 extending towards the first cover body 110. In this configuration, the annular boss 121 can be used as an air inlet for external gas to enter the air pump. Meanwhile, the first cover body 110 is provided with an avoidance hole 111 corresponding to the annular boss 121, and a gap is formed between the avoidance hole 111 and the annular boss 121. It should be noted that the magnetic element 130 should be disposed around the avoidance hole 111, and the first cover body 110 and the second cover body 120 together form a chamber 140 for accommodating the magnetic element 130.

In this embodiment, by providing the magnetic element 130, the air pump can be attached onto metal parts via magnetic force, so as to adapt to various application scenarios, and to improve the versatility and practicability of the air pump. At the same time, the magnetic element 130 is arranged around the avoidance hole 111, which enables a stable attachment of the air pump to the metal parts without affecting the inflation function of the air pump. The structure is optimized and the space utilization rate is high. In addition, the formation of a gap between the avoidance hole 111 and the annular boss 121 is conducive to the connection of the air pump to various products, which further improves the versatility of the air pump.

Figure 2:
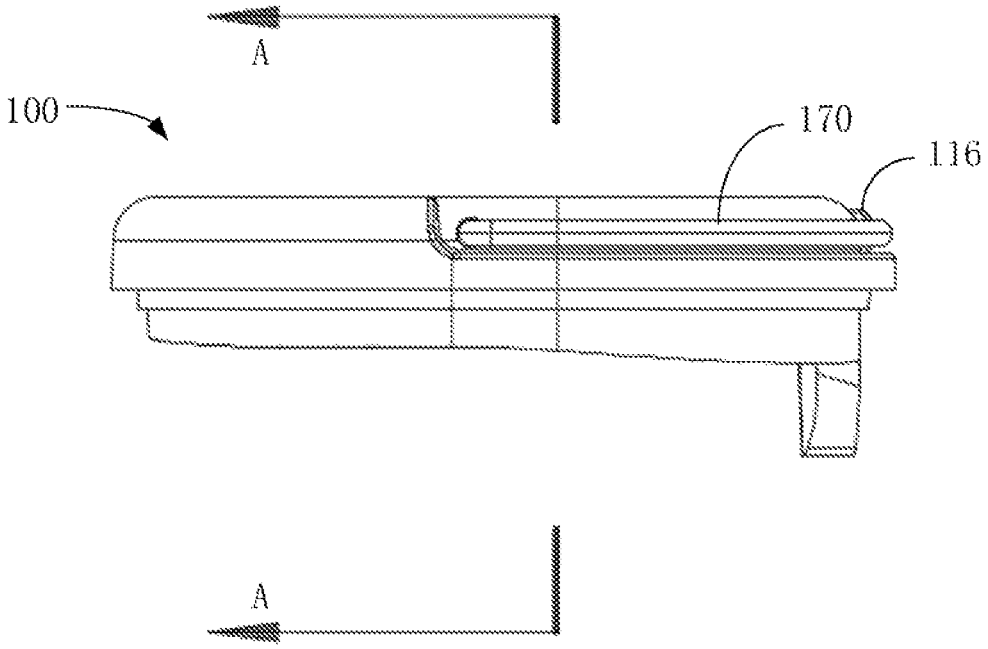
FIG. 2 is a side view of the air pump upper cover provided by this application.
Figure 3:
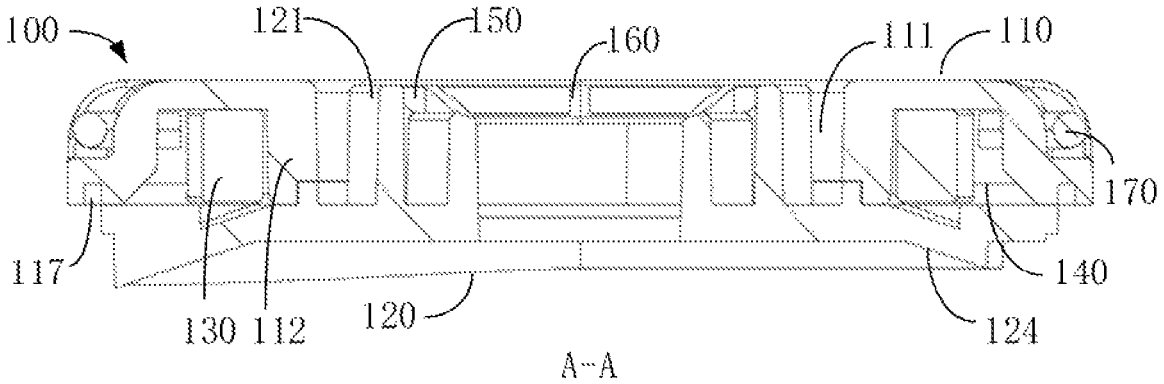
FIG. 3 is a sectional view along the A-A direction shown in FIG. 2.
Figure 4:
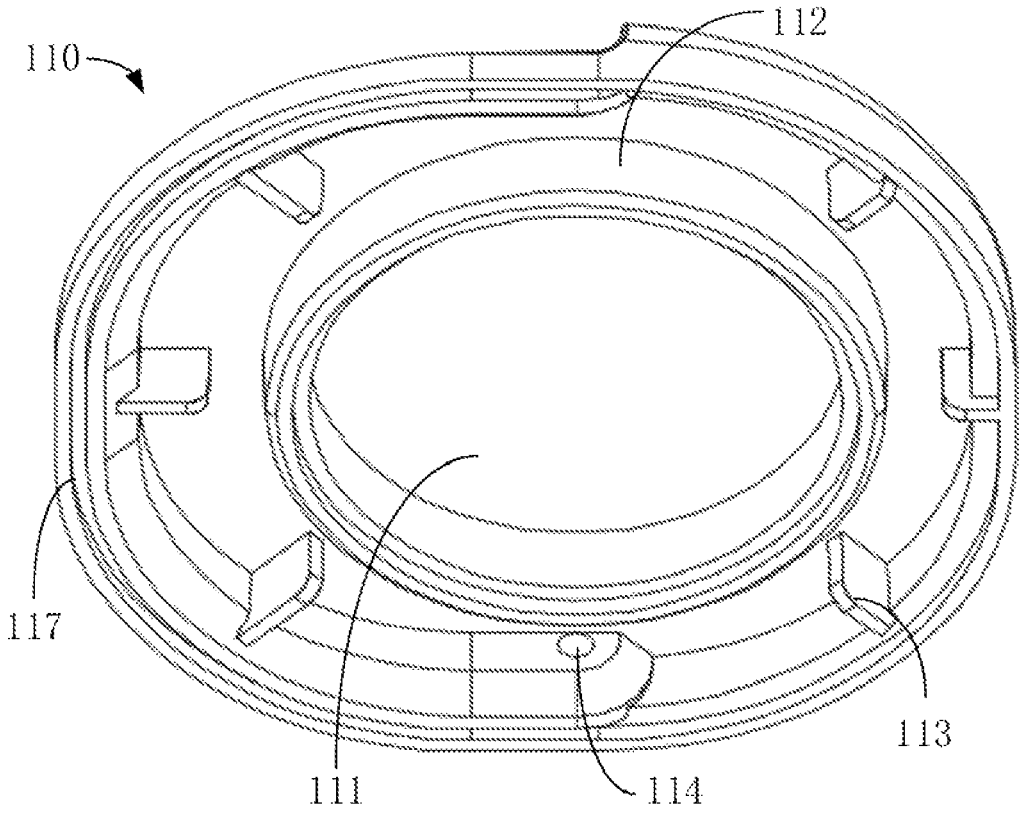
FIG. 4 is a three-dimensional schematic structure diagram of the first cover body provided by this application.

Preferably, referring to FIG. 2 and FIG. 3, in another embodiment, the annular boss 121 should not protrude from the first cover body 110, so that the structure is optimized, to achieve convenient attachment and an aesthetic appearance.

In one embodiment, referring to FIGS. 3 to 6, a contacting boss 112 extends from the edge of the avoidance hole 111 towards the second cover body 120 for contacting against the second cover body 120, and the side of the first cover body 110 facing the second cover body 120 is provided with a plurality of contacting blocks 113, which contact and hold the magnetic element 130 together with the contacting boss 112. At this point, the first cover body 110 and the second cover body 120 are assembled together, and the installation and fixation of the magnetic element 130 can be achieved.

Of course, in one embodiment, the contacting boss 112 may also be configured on the side of the second cover body 120 facing the first cover body 110, at the corresponding area of the avoidance hole 111, for docking to the first cover body 110. At this point, a plurality of contacting blocks 113 are provided on the side of the first cover body 110 facing the second cover body 120, which contact and hold the magnetic element 130 together with the contacting boss 112.

Similarly, in another embodiment, the first cover body 110 and the second cover body 120 can both be provided with contacting bosses 112 that are matched to each other, to contact and hold the magnetic element 130 together with a number of contacting blocks 113. The actual configuration, which can be flexibly set according to the actual situation, should not be considered as restrictions to this application, and are all within the protection scope of the present application.

Figure 5:
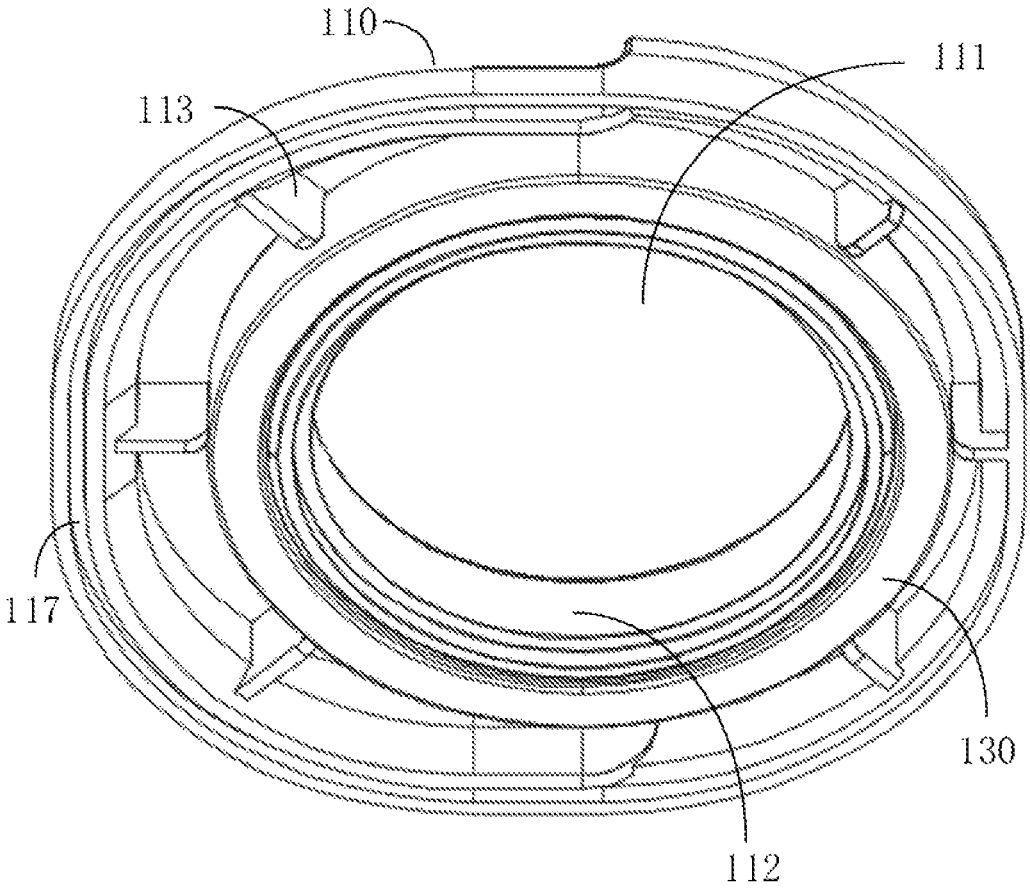
FIG. 5 is a three-dimensional schematic structure diagram of a first cover body and a magnetic element provided by this application, in the shown state.

Preferably, referring to FIG. 5, the magnetic element 130 is a magnet with an annular structure, surrounding the contacting boss 112, and a plurality of contacting blocks 113 are evenly spaced around the avoidance hole 111.

Of course, in actual production, the magnetic element 130 can also be in an arc-shaped structure. In such cases, a plurality of magnetic elements 130 can be evenly arranged around the contacting boss 112, which can also stably attach the air pump onto metal parts. These embodiments are also within the scope of protection of this application.

It is worth noting that, when the magnetic element 130 has an arc-shaped structure, a plurality of contacting blocks 113 may also be disposed on the contacting boss 112 to further improve the effect of the contacting boss 112 and the plurality of contacting blocks 113 at fixing the magnetic element 130.

Figure 7:
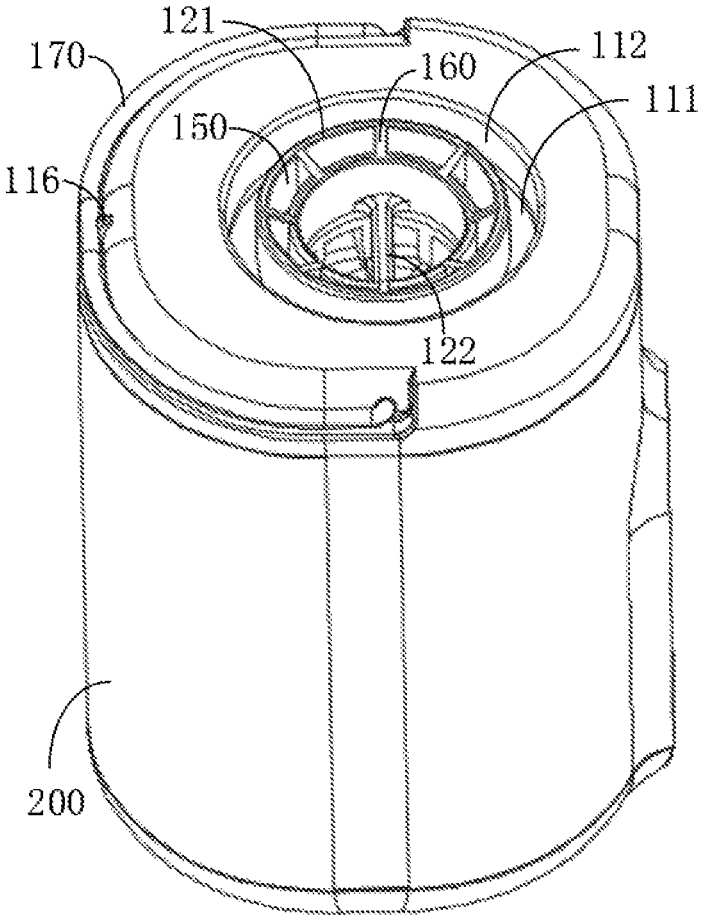
FIG. 7 is a three-dimensional schematic structure diagram of the air pump provided by this application.

Further, referring to FIG. 1 and FIG. 7, the inner side of the annular boss 121 is provided with a stopper 122 for preventing the user's fingers from being involved, which greatly improves the safety of the air pump provided in this embodiment. Specifically, the stopper 122 has a long strip structure, which ensures that the user's fingers are not easily involved while not affecting the air intake of the air pump at the same time. The structure is optimized and has high practicability and safety.

Figure 8:
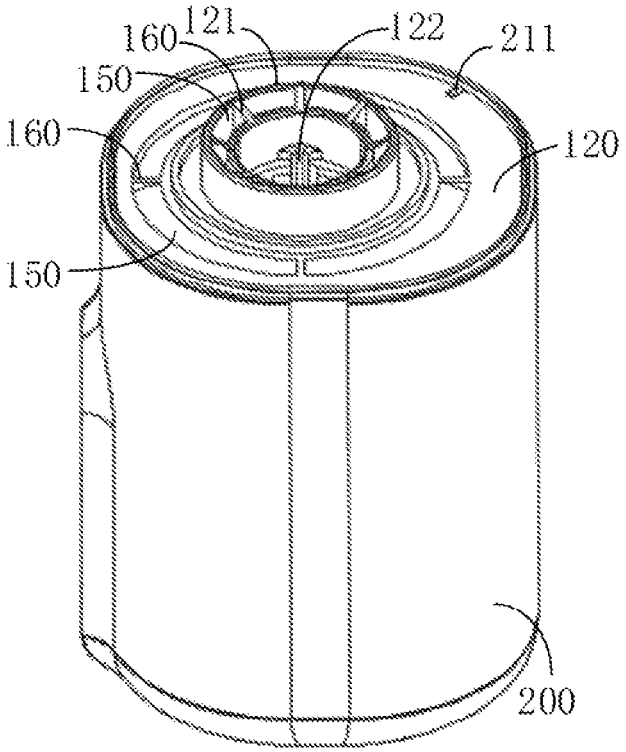
FIG. 8 is a three-dimensional schematic structure diagram of the air pump provided by this application, with the first cover body and the magnetic element removed.
Figure 9:
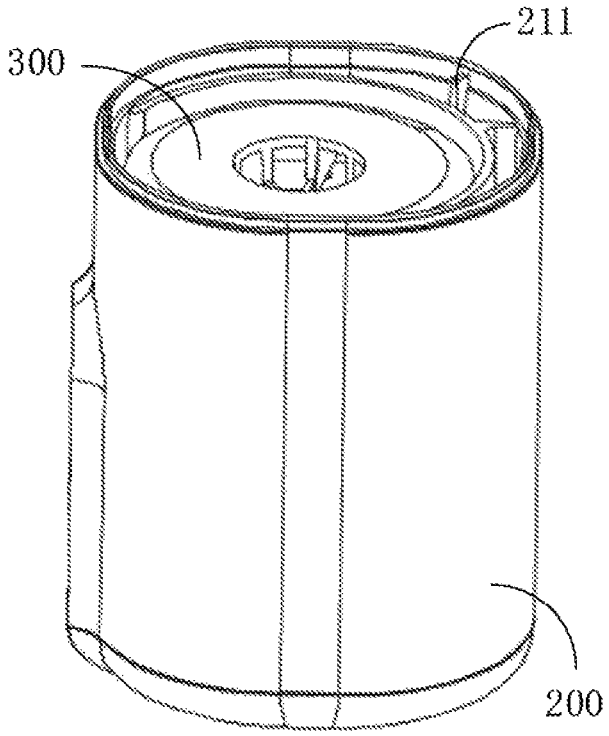
FIG. 9 is a three-dimensional schematic structure diagram of the air pump provided by this application with the air pump upper cover removed.

Further, referring to FIGS. 7 and 8, in order to reduce the overall weight of the air pump upper cover 100 and achieve lightweight production, the annular boss 121 is provided with a number of cavities 150 on the side facing the first cover body 110, and a reinforcing rib 160 is formed between each two adjacent cavities 150. On the other hand, a plurality of cavities 150 are provided in the second cover body 120 at the area corresponding to the magnetic element 130, and a reinforcing rib 160 is formed between every two adjacent cavities 150.

In actual production, the number of weight-reducing cavities can be configured according to actual needs, which should not limit this application, and falls within the protection scope of the present application.

In one embodiment, as shown in FIGS. 1, 2, 6 and 7, a hanging ring 170 is provided on the side of the first cover body 110 away from the second cover body 120, preferably made of stainless steel. At this point, the hanging ring 170 can be grasped by the user, making the air pump convenient to carry, and can be used to hang the air pump to a desired place, which increases the application scenarios of the air pump and greatly improves its versatility.

Specifically, the hanging ring 170 has a semi-circular structure, and both ends are provided with a fixing structure. At this point, two mounting holes 114 are symmetrically provided on the side of the first cover body 110 away from the second cover body 120, to match the fixing structures.

Figure 6:
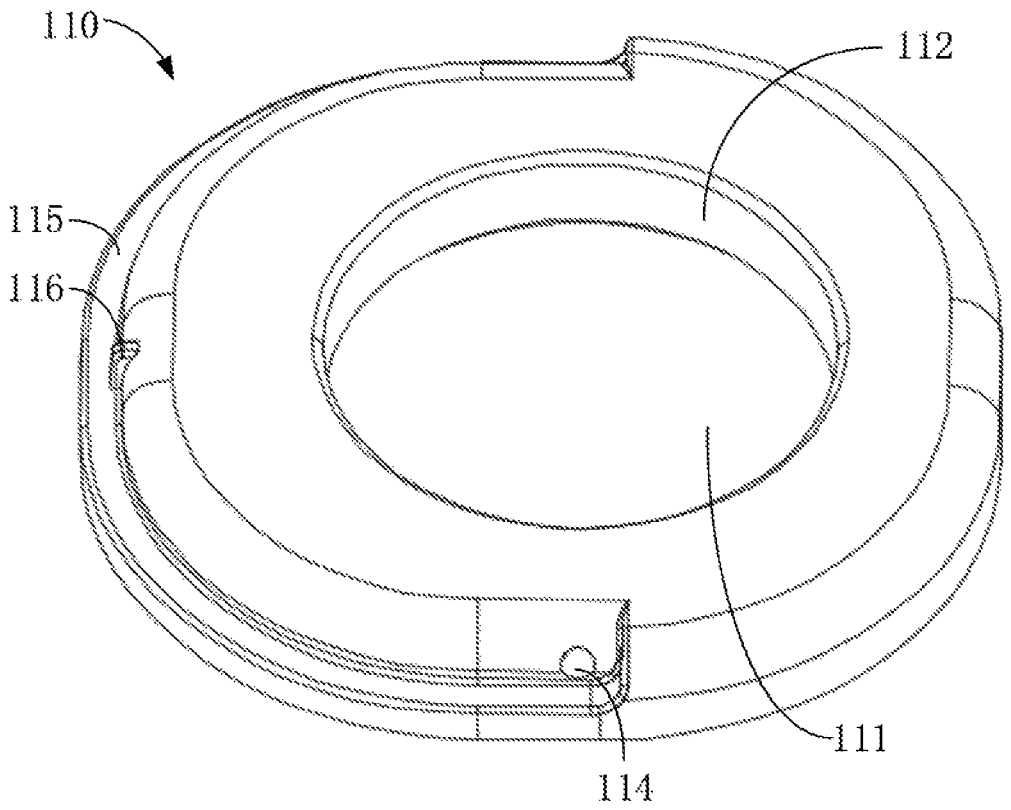
FIG. 6 is a three-dimensional schematic structure diagram of the first cover body provided by this application, in another state.

Preferably, referring to FIG. 6 and FIG. 7, the edge of the first cover body 110 is provided with a placement groove 115 for placing the hanging ring 170. The structure is optimized and the appearance is aesthetic. At the same time, the side wall of the placement groove 115 is provided with at least one locking block 116 for retaining the hanging ring 170, so that the hanging ring 170 will not easily escape from the placement groove 115 when not in use.

In actual production, the number and arrangement of the locking blocks 116 can be flexibly configured according to the actual situation, which will not be detailed here. As long as the hanging ring 170 can be clamped to the placement groove 115, the configurations are all within the protection scope of the present application.

Referring to FIGS. 7 to 10, the present application further provides an air pump, which may specifically include a casing 200, an impeller 300, a driving member 400 and the air pump upper cover 100 provided in any of the above embodiments. At this point, the side edge or the bottom of the casing 200 is provided with an exhaust port, and the casing 200 is provided with a first chamber 210 and a second chamber 220 for placing the impeller 300 and the driving member 400 respectively. The impeller 300 and the driving member 400 are operably connected. The air pump upper cover 100 covers the first chamber 210. When driven by the driving member 400, the impeller 300 sucks external gas into the first chamber 210 through the annular boss 121 and vents the gas through the exhaust port. Wherein, the driving member 400 is preferably a motor.

Specifically, referring to FIG. 3, FIG. 4, FIG. 5 and FIG. 10, the side of the first cover body 110 facing the casing 200 is provided with an engaging groove 117 for docking with the casing 200 and to seal the first chamber 210.

In order to further improve the inflating efficiency of the air pump, the annular boss 121 should rightly face the impeller 300 to increase the gas flow rate per unit time at the air inlet, greatly improving the working efficiency of the air pump.

Preferably, referring to FIGS. 1 and 8, a positioning block 211 is provided at the edge of the first chamber 210, and a positioning hole 123 is provided at the corresponding region of the second cover body 120. When the positioning block 211 is snap-fitted into the positioning hole 123, the casing 200 and the air pump upper cover 100 can be positioned.

In this embodiment, the positioning block 211 and the positioning hole 123 are provided, so that the user can quickly position the air pump upper cover 100 and the casing 200, so that the annular boss 121 rightly faces the impeller 300, to speed up the assembly speed and to improve the production efficiency.

Figure 10:
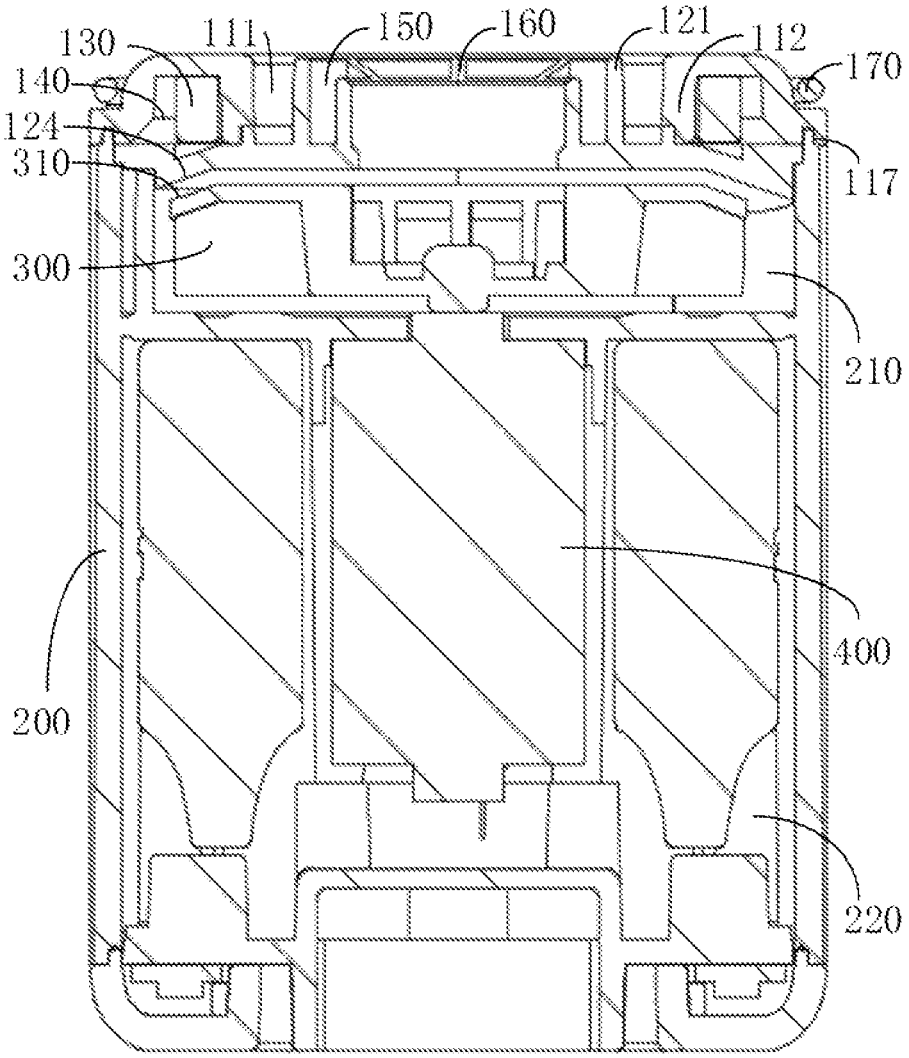
FIG. 10 is a cross-sectional view of the air pump provided by this application.

Further, referring to FIG. 10, at the side of the impeller 300 facing the air pump upper cover 100, and at the end facing the side wall of the first chamber 210, the impeller 300 is provided with a first drainage slope 310, so as to guide the gas in the first chamber 210 to the circumference of the first chamber 210.

In this embodiment, if the exhaust port is provided on the side of the casing 200, the exhaust port should be provided on the circumference of the first chamber 210. By setting the first drainage slope 310, more gas will flow to the exhaust port opened on the side edge of the casing 200, so as to increase the flow rate of the gas discharged from the exhaust port per unit time.

On the contrary, if the exhaust port is provided at the bottom of the casing 200, then a gas flow channel should be provided at the circumference of the first chamber 210 to guide the gas to the exhaust port. At this point, by arranging the first drainage slope 310, more gas can be guided to the gas flow channels provided on the side edge of the casing 200, thereby increasing the gas flow rate of the exhaust port per unit time.

Of course, considering the optimized arrangement of the overall structure, in this embodiment, the exhaust port is preferably configured at the bottom of the casing 200.

In this embodiment, by configuring the first drainage slope 310, the collision between the gas and the first chamber 210 can be effectively reduced, and the impact of the collision on gas flow rate is avoided, and the noise generated by the collision of high-speed gas is also reduced, the same with the noise pollution of the air pump to the environment.

In actual production, the first drainage slope 310 may also have an arc structure, etc., which does not limit this application, and can be flexibly set according to actual needs, and are all within the protection scope of the present application.

Further, referring to FIG. 1, FIG. 3 and FIG. 10, at the side of the second cover body 120 facing the casing 200, and at the area corresponding to the first drainage slope 310, a second drainage slope 124 parallel to the first drainage slope 310 is provided.

At this point, the first drainage slope 310 and the parallel second drainage slope 124 form a channel for gas passage, which improves the drainage effect of the first drainage slope 310, thereby improving the gas guiding in the first chamber 210. The efficiency of the air pump is improved, and at the same time, the noise pollution of the air pump to the environment is also reduced.

Preferably, when the exhaust port is provided at the bottom of the casing 200, a third drainage slope can be provided to the second cover body 120 at the position corresponding to the gas flow channel, so as to guide more gas to the gas flow channel, thereby improving the inflation efficiency of the air pump and effectively reduce the noise pollution of the air pump to the environment.

It should be noted that the above embodiments can be freely combined as needed. The above are only the preferred embodiments of the present application. It should be pointed out that for those skilled in the art, without departing from the principles of the present application, several improvements and modifications can also be made. These should be regarded as within the protection scope of the present application.

The invention claimed is:

1. An air pump upper cover for an air pump, comprising:

a main body and a magnetic element arranged in the main body;

wherein the main body includes a first cover body and a second cover body, and the second cover body is provided with an annular boss extending towards the first cover body, and the first cover body is provided with an avoidance hole corresponding to the annular boss, and a gap is provided between the avoidance hole and the annular boss;

wherein the magnetic element is disposed around the avoidance hole, and configured to allow the air pump to attach to ferromagnetic metal parts via magnetic force, while the first cover body and the second cover body together form a chamber for accommodating the magnetic element, wherein the annular boss forms an air inlet of the air pump.

2. The air pump upper cover according to claim 1, wherein, an edge of the avoidance hole is provided with a contacting boss extending towards the second cover body for docking the second cover body, and, a side of the first cover body facing the second cover body is provided with a plurality of contacting blocks, which contact and hold the magnetic element together with the contacting boss.

3. The air pump upper cover according to claim 2, wherein, the magnetic element has a ring-shaped structure and surrounds the contacting boss;

and the contacting blocks are evenly spaced around the avoidance hole.

4. The air pump upper cover according to claim 1, characterized in that wherein, an inner side of the annular boss is provided with a stopper for preventing a user's fingers from being involved.

5. The air pump upper cover according to claim 1, characterized in that wherein, a hanging ring is provided on a side of the first cover body away from the second cover body.

6. The air pump upper cover according to claim 5, wherein, an edge of the first cover body is provided with a placement groove for placing the hanging ring, and a side wall of the placement groove is provided with at least one locking block for holding the hanging ring.

7. An air pump, comprising:

a casing, an impeller, a driving member and air pump upper cover;

wherein the air pump upper cover comprises a main body and a magnetic element arranged in the main body;

wherein the main body includes a first cover body and a second cover body, and the second cover body is provided with an annular boss extending towards the first cover body, and the first cover body is provided with an avoidance hole corresponding to the annular boss, and a gap is provided between the avoidance hole and the annular boss;

wherein the magnetic element is disposed around the avoidance hole, and configured to allow the air pump to attach to ferromagnetic metal parts via magnetic force, while the first cover body and the second cover body together form a chamber for accommodating the magnetic element;

wherein a side edge or a bottom of the casing is provided with an exhaust port, and the interior of the casing is provided with a first chamber and a second chamber, which are respectively used for placing the impeller and the driving member, wherein the impeller and the driving member are operably connected;

wherein the air pump upper cover covers the first chamber, and when driven by the driving member, the impeller sucks external gas into the first chamber through the annular boss, and vents the gas through the exhaust port, wherein the annular boss forms an air inlet of the air pump.

8. The air pump of claim 7, wherein, a side of the first cover body facing the casing is provided with an engaging groove for docking with the casing.

9. The air pump according to claim 7, wherein, an edge of the first chamber is provided with a positioning block, and a corresponding area of the second cover body is provided with a positioning hole;

wherein the positioning block is snap-fitted with the positioning hole to position the casing and the air pump upper cover.

10. The air pump according to claim 7, wherein, a side of the impeller facing the air pump upper cover, at an end facing a side wall of the first chamber, is provided with a first drainage slope, so as to guide the gas in the first chamber to the circumference of the first chamber; and at a side facing the casing, and at a region corresponding to the first drainage slope, the second cover body is provided with a second drainage slope parallel to the first drainage slope.

11. The air pump according to claim 7, wherein, at a side facing the first cover body and at the area corresponding to the avoidance hole, the second cover body is provided with a contacting boss extending towards the first cover body, for docking the first cover body, and, a side of the first cover body facing the second cover body is provided with a plurality of contacting blocks, which contact and hold the magnetic element together with the contacting boss.

12. The air pump according to claim 11, wherein, the magnetic element has a ring-shaped structure and surrounds the contacting boss;

and the contacting blocks are evenly spaced around the avoidance hole.

13. The air pump according to claim 7, wherein, an inner side of the annular boss is provided with a stopper for preventing a user's fingers from being involved.

14. The air pump according to claim 7, wherein, a side of the annular boss facing the first cover body is provided with a plurality of cavities, and a reinforcing rib is formed between every two adjacent cavities.

15. The air pump according to claim 7, wherein, a hanging ring is provided on a side of the first cover body away from the second cover body.

16. The air pump upper cover according to claim 15, wherein, an edge of the first cover body is provided with a placement groove for placing the hanging ring, and a side wall of the placement groove is provided with at least one locking block for holding the hanging ring.

17. The air pump according to claim 11, wherein, the magnetic element is configured in an arc-shaped structure, and a plurality of magnetic elements are evenly arranged around the contacting boss.

18. The air pump upper cover according to claim 1, wherein, a side of the annular boss facing the first cover body is provided with a plurality of cavities, and a reinforcing rib is formed between every two adjacent cavities;

and, the second cover body is provided with a plurality of cavities at an area corresponding to the magnetic element, and a reinforcing rib is formed between every two adjacent cavities.

19. The air pump upper cover according to claim 2, wherein, the magnetic element is configured in an arc-shaped structure, and a plurality of magnetic elements are evenly arranged around the contacting boss.

20. The air pump upper cover according to claim 4, wherein, the stopper has a long strip structure.

* * * * *